US006540151B1

(12) United States Patent
Steiner et al.

(10) Patent No.: US 6,540,151 B1
(45) Date of Patent: Apr. 1, 2003

(54) HEATER, ESPECIALLY AN ENGINE-INDEPENDENT VEHICLE HEATING SYSTEM

(75) Inventors: Peter Steiner, Aichwald (DE); Tobias Knies, Waiblingen (DE); Dirk Brenner, Stuttgart (DE)

(73) Assignee: Eberspacher GmbH & Co., Esslingen (DE)

( * ) Notice: Subject to any disclaimer, the term of this patent is extended or adjusted under 35 U.S.C. 154(b) by 0 days.

(21) Appl. No.: 09/958,052

(22) PCT Filed: Jan. 9, 2001

(86) PCT No.: PCT/EP01/00143

§ 371 (c)(1),
(2), (4) Date: Mar. 12, 2002

(87) PCT Pub. No.: WO01/57446

PCT Pub. Date: Aug. 9, 2001

(30) Foreign Application Priority Data

Feb. 2, 2000 (DE) ..... 100 04 507

(51) Int. Cl.[7] ..... B60H 1/02
(52) U.S. Cl. ..... 237/12.3 C; 431/262
(58) Field of Search ..... 237/12.3 C, 2 A; 126/110 B, 116 R; 431/262

(56) References Cited

U.S. PATENT DOCUMENTS

| | | | | |
|---|---|---|---|---|
| 4,828,488 A | | 5/1989 | Reiser et al. | |
| 4,964,797 A | * | 10/1990 | Hilton | 122/17.1 |
| 5,020,991 A | * | 6/1991 | Schaale et al. | 126/110 B |
| 5,082,175 A | * | 1/1992 | Koch et al. | 126/110 B |
| 5,090,896 A | * | 2/1992 | Kenner et al. | 126/110 B |
| 5,197,871 A | * | 3/1993 | Yamamoto et al. | 126/110 B |
| 5,938,429 A | * | 8/1999 | Brenner | 237/12.3 C |

FOREIGN PATENT DOCUMENTS

| | | | |
|---|---|---|---|
| DE | 42 43 712 C1 | 12/1992 | F23D/11/36 |
| DE | 195 29 994 A1 | 8/1995 | F23D/5/00 |

* cited by examiner

*Primary Examiner*—Derek Boles

(57) ABSTRACT

An engine-independent vehicle heating system has a connection piece that communicates with a combustion chamber and is linked with a fuel supply. The heater system has a glowing body that is fastened in the connection piece and evaporates and ignites the fuel at least during a starting phase of the heater system. A sieve element that is disposed in the connection piece encloses the glowing body and transports the fuel supplied to the connection piece in the direction of the combustion chamber. The sieve element in the interior of the connection piece is at least partially spaced from an inner wall of the connection piece facing the sieve element.

20 Claims, 2 Drawing Sheets

HEATER, ESPECIALLY AN ENGINE-INDEPENDENT VEHICLE HEATING SYSTEM

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

The invention relates to a heating device, particularly an engine-independent vehicle heater, with a connecting pipe that communicates with a combustion chamber and is connected to a fuel supply means, with a glow plug which is fastened in the connecting pipe and serves to vaporize and ignite the fuel, at least during a starting phase of the heater, and with a sieve element which is arranged in the connecting pipe, surrounds the glow plug, and passes-on the fuel supplied to the connecting pipe toward the combustion chamber. In conventional heating devices, the sieve element is fitted into the connecting pipe such that an inner wall of the connecting pipe is covered and lined by the sieve element.

TECHNICAL FIELD

Such a heating device is operated with a fuel, e.g., diesel oil, which is liquid under the surrounding conditions. The glow member, e.g., a glow plug or a glow pin, is activated during a starting phase in order to produce heat to ignite the heating device. As soon as the glow member has reached a sufficient temperature in a glow zone, the fuel and fresh air are fed to the connecting pipe according to a special starting procedure. The liquid fuel then enters the connecting pipe and flows along an inner wall of the pipe connection, where the liquid fuel comes into contact with the sieve element lining the inner wall of the connecting pipe. The liquid fuel is sucked up and transported along the inner wall of the connecting pipe toward the combustion chamber, because of a capillary effect due to the structure of the sieve element, which is usually formed by a wire fabric. Since the sieve element envelops the glow member, the liquid fuel distributed on the large surface of the sieve element is evaporated by the heating effect of the glow member. As soon as an ignitable mixture has formed, the combustion of the air-fuel mixture automatically takes place. The combustion chamber can then be ignited by the combustion attained in the connecting pipe. As soon as a stable combustion is present in the combustion chamber, the glow member can be deactivated again.

The glow member must meet high performance requirements in order to ensure a reliable ignition of the fuel respectively used. For example, a relatively high temperature has to be attained with the glow member, due to which the working and service life of the glow member is reduced. In particular, the use of so-called "biodiesel" or "PME" as the fuel is achieving increasing importance, but requires a particularly large heat supply for evaporation and ignition.

SUMMARY OF THE INVENTION

The present invention is concerned with the problem of designing a heating device of the kind stated at the beginning so that an increased working life of the glow member can be ensured. The heating device is furthermore to be operated with fuels such as biodiesel which boil with relative difficulty. This problem is solved according to the invention by a heating device with the features of a fuel supply, a connecting pipe having an inner wall, which communicates with a combustion chamber and is connected to the fuel supply, a glow member, which is fastened in the connecting pipe and serves to evaporate and ignite fuel, at least during a starting phase of the heating device, a sieve element, which is arranged in the connecting pipe, surrounds the glow member, and passes-on fuel supplied to the connecting pipe in a direction of the combustion chamber. The sieve element is spaced within the connecting pipe from at least a region of the inner wall facing toward the sieve element.

The invention is based on the general concept of arranging the sieve element in the connecting pipe in a manner such that a spacing or gap is formed between the sieve element and the inner wall of the connecting pipe, at least in some regions. The regional spacing of the sieve element from the inner wall can be formed, for example, by an annular gap. It is likewise possible to form several, axially spaced-apart, annular spaces. Several axially-extending spacing-apart spaces can also be formed, distributed along the external circumference of the sieve element. A separating space which extends helically is also conceivable. In this manner the sieve element regionally has no contact with the inner wall of the connecting pipe, so that heat dissipation from the sieve element to the inner wall of the connecting pipe is reduced in these regions. This measure has the result that the sieve element and thus the fuel distributed over the surface of the sieve element requires less energy to attain the desired evaporation of the fuel. Correspondingly, a lower glow temperature is sufficient for the glow member in comparison with conventional heating devices, in order to evaporate and to ignite a usual kind of fuel. Since the glow member can thus be operated at lower glow temperatures, a longer service life of the glow member, and thus overall an increased use value for the heating device, are attained. It has furthermore been found that even fuels which boil with relative difficulty can be reliably ignited, without further measures, in the heating device constructed according to the invention. Correspondingly, the heating device according to the invention can be operated with fuels which boil or ignite with difficulty, such as e.g. biodiesel.

Corresponding to a preferred embodiment, the sieve element can be spaced apart, at least in a region surrounding the glow zone of the glow member, from the inner wall of the connecting pipe. In this region, the separation of the thermal coupling between the sieve element and the connecting pipe inner wall acts particularly clearly, since a particularly large temperature difference exists here in the starting phase between the glow member and the inner wall of the connecting pipe.

The sieve element can appropriately be fastened to the connecting pipe and/or to the glow member in a region remote from the glow zone of the glow member. The glow member has only a small heat development in this region, so that a thermally conducting bridge between the sieve element and the inner wall of the connecting pipe exhibits only a small effect on the evaporation of the fuel.

An embodiment of the invention in which at least one projection portruding from the sieve element toward the connecting pipe inner wall, and by means of which the sieve element is supported on the connecting pipe inner wall, is formed on the sieve element in a fastening region in which the sieve element is fastened or fixed to the connecting pipe.

By means of this feature, on the one hand the connecting pipe has a relatively large internal cross section, so that the transport of relatively large amounts of fuel can be ensured. On the other hand, the sieve element thereby also has a relatively large cross sectional surface, so that the suction effect of the sieve element is particularly large. A large suction effect of the sieve element is desired because a relatively large amount of fuel can thereby be conducted away from the glow member. Fuel which is distributed over the surface of the glow member causes cooling of the glow member on evaporation, thereby reducing its performance.

According to an embodiment of the invention, the sieve element can consist of a wire fabric, which has more layers of fabric in the region of the at least one projection than in the regions adjacent thereto. For example, the wire fabric of the sieve element can be made five-layered in the region of the at least one projection and three-layered in the remaining regions. The sieve element has an increased suction effect in the region of the projection because the wire fabric has more fabric layers in the region of the projection than in the regions adjacent thereto. A sieve element can be produced particularly easily from wire fabric. The wire fabric is preferably made from a steel wire. The sieve element can however be made from other materials as long as the required suction and transport effect is ensured. For example, a porous body is also suitable, and can in particular be made in one piece from a sintered material. Such a sintered body can be made, e.g., from a steel powder.

Further important features and advantages of the apparatus according to the invention will become apparent from the drawings and from the associated description of the Figures with reference to the drawings.

It will be understood that the features mentioned above and those to be explained hereinafter can be used, not only in the given combination, but also in other combinations or alone, without departing from the scope of the invention.

BRIEF DESCRIPTION OF THE DRAWINGS

Preferred embodiments of the invention are shown in the drawings and are described in more detail in the following description.

Respectively schematically.

DETAILED DESCRIPTION OF THE INVENTION

Figure 1:
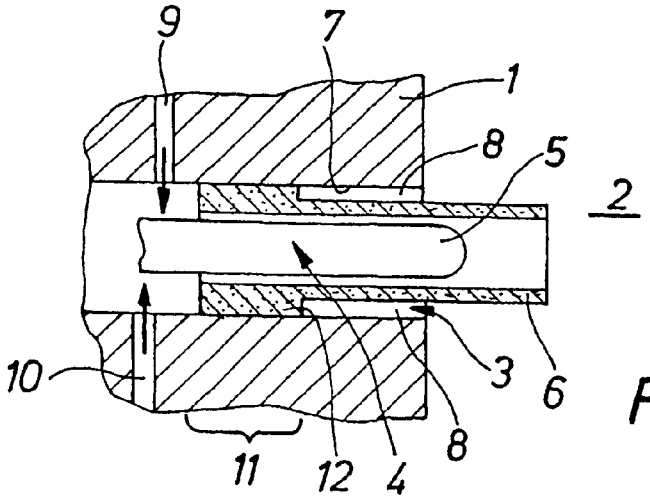
FIG. 1 shows a longitudinal section through a section of a connecting pipe in a heating device according to the invention, according to a first embodiment.

As shown in FIGS. 1–6, a connecting pipe 1 adjoins a combustion chamber 2, with an interior 3 of the connecting pipe 1 communicating with the combustion chamber 2. A glow member 4 is installed in the connecting pipe interior 3, and has a glow zone 5 in a region facing toward the combustion chamber 2. The glow member 4 is as a rule fastened to the connecting pipe 1 in a region (not shown here) facing away from the combustion chamber 2. The glow member 4 is usually provided with a screw thread and screwed into the connecting pipe 1.

A sieve element 6 is furthermore installed in the connecting pipe interior 3 such that a spacing or gap 8 is formed, at least regionally, between the sieve element 6 and an inner wall 7, situated opposite the sieve element 6, of the connecting pipe 1. Thus there is no bodily contact between the sieve element 6 and the connecting pipe inner wall 7 in these regions of the sieve element 6 which are spaced apart from the connecting pipe inner wall 7. A direct heat conduction between the sieve element 6 and the connecting pipe 1 is thus not present in these regions spaced apart from the connecting pipe inner wall 7.

Figure 4:
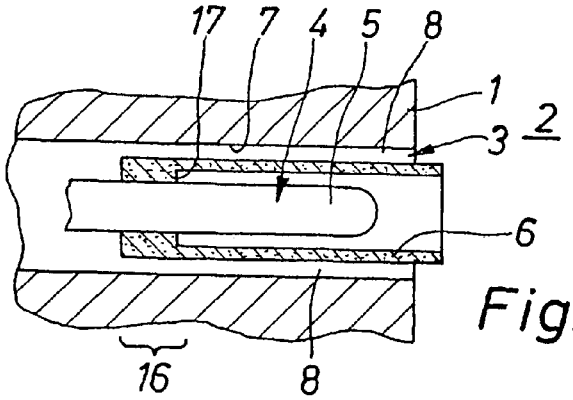
Figure 5:
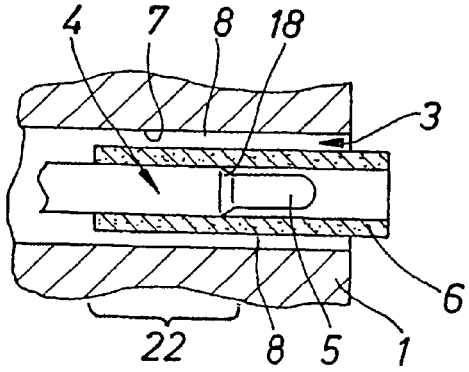

Relative to the glow member 4, the sieve element 6 is furthermore installed in the connecting pipe 1 such that the sieve element 6 has no direct contact, at least in the region of the glow zone 5, with the glow member 4. In the embodiments of FIGS. 4 and 5, the sieve element 6 is supported on the glow member 4, but in a region remote from the glow zone 5. In the remaining embodiments, there is no contact at all between the sieve element 6 and the glow member 4.

As shown in FIG. 1, liquid fuel can be fed via a fuel supply means 9 to the connecting pipe 1. The connecting pipe 1 is furthermore provided with a fresh air feed 10 which feeds fresh air to the connecting pipe 1, at least for a starting phase of the heating device, to then flow through the connecting pipe interior 3 into the combustion chamber 2.

In the embodiments shown here, the connecting pipe interior 3 is constructed as cylindrical, by way of example, and is in particular circular cylindrical. Correspondingly, the glow member 4 also has a substantially cylindrical form. Likewise, the sieve element 6 is made sleeve-shaped and substantially cylindrical.

Corresponding to FIG. 1, a projection 12 is formed on the sieve element 6 and extends closed, along the whole periphery, standing away outward from the sieve element 6 in the direction toward the connecting pipe inner wall 7, in a fastening region 11 symbolized by a curved bracket and remote from the combustion chamber 2. Correspondingly, this projection 12 is likewise made annular here. The sieve element 6 has a step in its diameter due to the annular projection 12. The dimensions of the projection 12 are thus preferably matched to the cross section of the connecting pipe interior 3, so that a press fit is formed between the sieve element 6 and the connecting pipe inner wall 7 in the fastening region 11, and is sufficient to fix or fasten the sieve element 6 in the connecting pipe 1. This embodiment works particularly well, since the liquid fuel supplied via the fuel supply means 9 first flows along the connecting pipe inner wall 7 and then strikes the sieve element 6 at the region 11 provided with the projection 12. By means of the structure of the sieve element 6, for example, which can be constructed, for example, of wire fabric or as a porous, integral body, the liquid fuel is sucked up by the sieve element 6 and transported in the direction of the combustion chamber 2. Since the sieve element 6 has an enlarged cross section in the fastening region 11 facing toward the fuel feed 9, the sieve element 6 has a particularly large suction force In the embodiment according to FIG. 1, the sieve element 6 outside the fastening region 11 is without contact with the connecting pipe inner wall 7, so that the gap or space 8 extends annularly.

Figure 2:
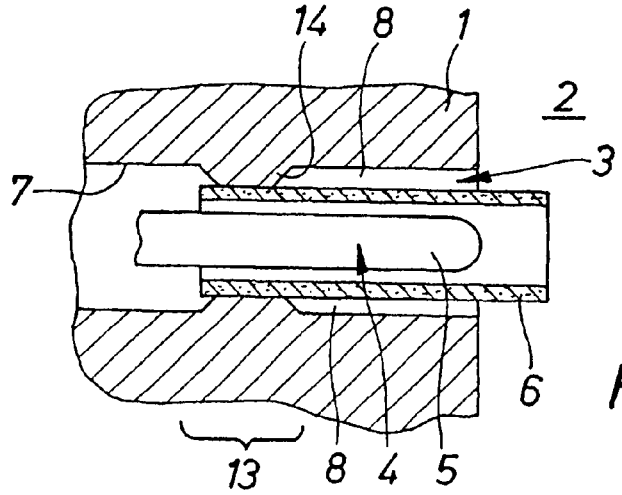
FIGS. 2–6 show simplified views as in FIG. 1, but of other embodiments.

As shown in FIG. 2, a projection 14, protruding from the connecting pipe inner wall 7 and extending inward as far as the sieve element 6, can be formed on the connecting pipe inner wall 7 in a fastening region 13, indicated by a brace and remote from the combustion chamber 2. Here also, the dimensions are appropriately chosen so that a press fit results between the projection 14 and the sieve element 6, and is sufficient to fix the sieve element 6 in the connecting pipe 1.

Instead of a single projection 12 (see FIG. 1) or 14 (see FIG. 2) extending annularly along the periphery of the sieve element 6, plural projections can also be provided, distributed along the periphery of the sieve element 6 at plural places, by means of which the sieve element 6 is supported at plural places, in particular symmetrically, on the connecting pipe inner wall 7.

Figure 3:
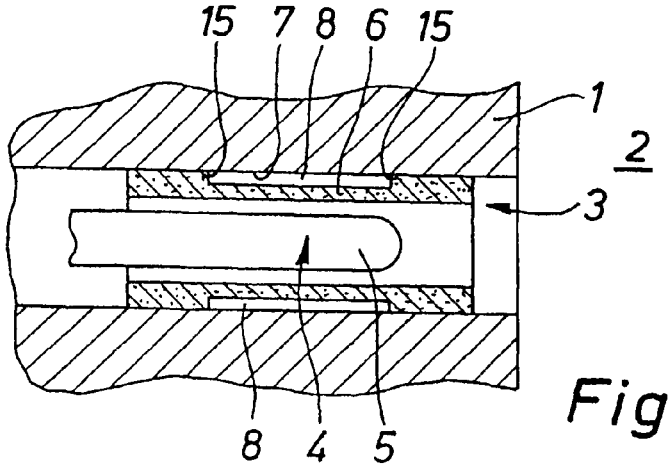

As shown in FIG. 3, the sieve element 6 can also have two annular projections 15, which are axially spaced apart from one another and protrude radially outward, and by which the sieve element 6 is supported in the connecting pipe 1, and which ensure the fastening of the sieve element 6 due to the chosen dimensions. In this embodiment, the space 8 formed between the connecting pipe inner wall 7 and the sieve element 6 is likewise made annular, but is limited axially in both directions by the projections 15.

As shown in FIG. 4, a projection 17, by means of which the sieve element 6 is supported on the glow member 4, and in fact in a region remote from the glow zone 5, can be formed on the sieve element 6, protruding radially inward in a fastening region 16, denoted by a curved bracket, remote from the combustion chamber 2. A press fit can be formed here also by correspondingly chosen dimensions, and is sufficient to fasten the sieve element 6 in the connecting pipe 1. In this embodiment, the sieve element 6 has no contact at all with the connecting pipe inner wall 7, so that heat transfer between the sieve element 6 and the connecting pipe inner wall 7 is greatly hindered.

As shown in FIG. 5, the glow member 4 can extend stepwise radially outward in a fastening region 22 remote from its glow zone 5, so that a projection 18 is likewise formed on which the sieve element 6 is supported on the glow member 4.

Figure 6:
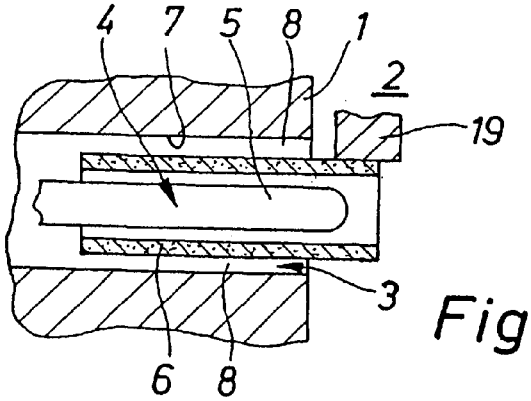

As shown in FIG. 6, the sieve element 6 can also be fastened on a combustion chamber component 19, here shown only symbolically, and can project without contact into the connecting pipe inner wall 7, the sieve element 6 furthermore having no contact with the glow member 4.

Figure 7:
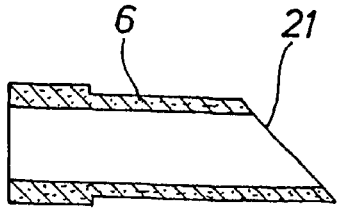

As shown in FIG. 7, the sieve element 6 can be formed with a bevel 21 at its end exposed to the combustion chamber 2.

Figure 8:
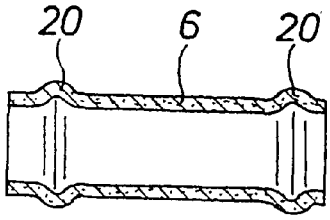
FIGS. 7 and 8 show longitudinal sections of further embodiments of sieve elements of the heating device according to the invention.

According to FIG. 8, projections 20 extending radially outward can be formed on the sieve element 6 so that the wall thickness of the sieve element 6 is not enlarged in the region of these projections 20. For example, such projections 20 can be formed by an upsetting deformation of the sieve element 6.

The sieve element 6 is formed in the embodiments of FIGS. 1, 2, 4, 5 and 6 such that it protrudes beyond a mouth opening of the connecting pipe 1 and projects into the combustion chamber 2. Furthermore, in all the embodiments shown, the sieve element 6 projects out toward the combustion chamber 2 beyond an end of the glow member 4 facing toward the combustion chamber 2.

While the sieve element 6 can basically be produced from an optional suitable material, the production of the sieve element 6 from a wire fabric has particular advantages. For example, the projections 12, 15 and 17 can be produced particularly easily in a sieve element 6 constructed as a wire fabric, in that the wire fabric has more fabric layers in the region of these projections than in the adjoining regions. For example, the sieve element 6 is basically of three-layered construction and is provided in the neighborhood of the projections 12, 15, 17 with two additional layers, so that the sieve element 6 has a five-layered wire fabric in the region of its projections 12, 15, 17.

In the heating device according to the invention, the sieve element 6 is regionally spaced apart from the connecting pipe inner wall 7, particularly in the region of the glow zone 5, by means of gaps, spacings, or spaces, 8. In these regions spaced apart from the connecting pipe inner wall 7, the heat transfer from the sieve element 6 to the connecting pipe inner wall 7 is reduced. Correspondingly, more heat energy is available for the heating of the fuel distributed on the surface of the sieve element 6. As a whole, the evaporation and ignition of the fuel can thus be realized with a smaller heat output from the glow member 4, so that this can operate at a lower glow temperature and thus has a longer service life. In particular, the ignition of fuels such as biodiesel which boil with difficulty or are difficult to vaporize is simplified by the constitution proposed according to the invention.

What is claimed is:

1. A heating device comprising:

a fuel supply, a connecting pipe having an inner wall, which communicates with a combustion chamber and is connected to said fuel supply, a glow member, which is fastened in said connecting pipe and serves to evaporate and ignite fuel, at least during a starting phase of said heating device, a sieve element, which is arranged in said connecting pipe, surrounds said glow member, and passes-on fuel supplied to said connecting pipe in a direction of said combustion chamber, wherein said sieve element is spaced within said connecting pipe from at least a region of said inner wall facing toward said sieve element.

2. The heating device according to claim 1, wherein said glow member comprises a glow zone and said sieve element is spaced from said inner wall at least in a region surrounding said glow zone of said glow member.

3. The heating device according to claim 1, wherein said glow member comprises a glow zone and said sieve element is fastened to at least one of said connecting pipe and said glow member in a region remote from said glow zone.

4. The heating device according to claim 1, further comprising to at least one projection formed on said sieve element, protruding from said sieve element toward said inner wall, and supporting said sieve element on said inner wall in a fastening region in which said sieve element is fastened to said connecting pipe.

5. The heating device according to claim 1, further-comprising at least one projection formed on said inner wall, protruding from said inner wall toward said sieve element, and supporting said sieve element on said inner wall in a fastening region in which said sieve element is fastened to said connecting pipe.

6. The heating device according to claim 1, further comprising at least one projection formed on said sieve element and protruding from said sieve element toward said glow member in a fastening region in which said sieve element is fastened and supported on said glow member.

7. The heating device according to claim 1, further comprising at least one projection formed on said glow member, protruding from said glow member toward said sieve element, in a fastening region in which said sieve element is fastened and supported on said glow member.

8. A heating device comprising:

a fuel supply, a connecting pipe having an inner wall, which communicates with a combustion chamber and is connected to said fuel supply, a glow member, which is fastened in said connecting pipe and serves to evaporate and ignite fuel, at least during a starting phase of said heating device, a sieve element, which is arranged in said connecting pipe, surrounds said glow member, and passes-on fuel supplied to said connecting pipe in a direction of said combustion chamber, wherein said sieve element is spaced within said connecting pipe from at least a region of said inner wall facing toward said sieve element, further comprising a plurality of projections, formed and distributed peripherally in said fastening region.

9. A heating device comprising:

a fuel supply, a connecting pipe having an inner wall, which communicates with a combustion chamber and is connected to said fuel supply, a glow member, which is fastened in said connecting pipe and serves to evaporate and ignite fuel, at least during a starting phase of said heating device, a sieve element, which is arranged in said connecting pipe, surrounds said glow member, and passes-on fuel supplied to said connecting pipe in a direction of said combustion chamber, wherein said sieve element is spaced within said connecting pipe from at least a region of said inner wall facing toward said sieve element, further comprising a single, closed, peripheral projection formed in said fastening region.

10. The heating device according to claim 1, wherein said sieve element projects out of said connecting pipe in a longitudinal direction and into said combustion chamber.

11. The heating device according to claim 1, wherein said glow member has an end facing said combustion chamber and said sieve element projects in a longitudinal direction toward said combustion chamber and beyond said end of said glow member facing said combustion chamber.

12. The heating device according to claim 4, wherein said sieve element comprises a wire fabric that has more fabric layers in a region of said at least one projection than in regions adjacent thereto.

13. The heating device according to claim 12, wherein said wire fabric is five-layered in said region of said at least one projection and three-layered in a remainder of said wire projection.

14. The heating device according to claim 1, wherein said sieve element comprises at least one of porous material or sintered member.

15. The heating device according to claim 1, wherein said sieve element is pressed in between said glow member and said inner wall in a fastening region in which said glow member is fastened in said connecting pipe.

16. The heating device according to claim 15, wherein said fastening region is formed such that said glow member is pressed into said connecting pipe through said pressed in sieve element.

17. The heating device according to claim 1, wherein said sieve element is fastened outside said connecting pipe such that said sieve element projects into said connecting pipe.

18. The heating device according to claim 17, wherein said sieve element projects into said connecting pipe without contact with said inner wall.

19. The heating device according to claim 6, wherein said sieve element is arranged in said connecting pipe without contact with said inner wall.

20. The heating device according to claim 1, wherein said heating device comprises an engine-independent vehicle heating device.

* * * * *